United States Patent [19]

Colvin

[11] 4,285,504

[45] Aug. 25, 1981

[54] TUYERE SEALING MEANS AND SILENCER

[75] Inventor: Beal H. Colvin, Claypool, Ariz.

[73] Assignee: Inspiration Consolidated Copper Company, Inspiration, Ariz.

[21] Appl. No.: 99,633

[22] Filed: Dec. 3, 1979

[51] Int. Cl.[3] ..... C21B 7/16

[52] U.S. Cl. ..... 266/266; 266/218; 266/269

[58] Field of Search ..... 266/218, 266, 269, 186; 277/148, 149

[56] References Cited

U.S. PATENT DOCUMENTS 4,019,725 4/1977 Cote ..... 266/218

*Primary Examiner*—P. D. Rosenberg

*Attorney, Agent, or Firm*—Pennie & Edmonds

[57] ABSTRACT

A tuyere sealing means and silencer having a bell-shaped nozzle. A plurality of cutouts are included in the nozzle and receive radially movable ramp-type valve elements which are adapted to engage with a seal with the plurality of a punch rod. The valve elements are moved radially outwardly of the nozzle against the force of spring means when the punch rod is inserted through the tuyere sealing means.

6 Claims, 5 Drawing Figures

TUYERE SEALING MEANS AND SILENCER

FIELD OF THE INVENTION

The invention relates to a tuyere sealing means and silencer for use with metallurgical converters.

BACKGROUND OF THE INVENTION

Tuyere systems are used to inject or blow gases into metallurgical converters containing molten metal to enhance refining of the metal. The gases enter into the converter through a tuyere pipe which over a course of time may become clogged with residue and accumulations which impede flow of gas into the converter. It has been the practice to remove the accumulations from the the tuyere pipe by running a plunger rod through the pipe with the rod entering the pipe through a gas seal and silencer structure connected to the pipe. A check valve is associated with the gas seal structure to prevent blow-back through the gas seal under normal operating conditions when the punch rod is not inserted into the tuyere pipe. The check valve is adapted to be moved to the open position by contact with the punch rod when it is inserted through the tuyere pipe.

As the punch rod is inserted through the gas seal to contact the check valve, gas within the tuyere pipe tends to blow back and escape between its seal and the periphery of the punch rod. At the same time material can be ejected with the escaping gas creating dangerous working conditions. Further the escaping gas produces extremely high noise levels which can have an adverse effect on workers within the vicinity of the converting operations.

In addition loss of gas between the sealing means and the outer periphery of the punch rod can result in molten liquid in the converter flowing back through the tuyere pipe where it can solidify and result in a stoppage. Further escaping gas around the sealing means and the consequent drop of pressure within the converter can in some instances result in the converting action becoming dormant.

In an attempt to compensate for loss of gas during tuyere pipe cleaning operations, higher pressures and greater volumes of gas than actually needed in converting operations are forced through the gas inlet pipes feeding into the tuyere pipe resulting in increased costs of operation.

Various designs of gas seals have been proposed in an attempt to overcome the aforementioned problems. See for example the disclosures of U.S. Pat. Nos. 1,517,972 and 4,019,725. Both of these patents disclose gas seal structure utilizing radially movable seal elements which engage and seal with the outer periphery of the shank portion of a punch rod inserted through the tuyere pipe. The radially movable valve elements of the construction of these patents are susceptible to being bent and knocked out of line when the punch rod is inserted into the seal structure unless extreme care is taken to assure that the punch rod is accurately aligned with respect to the valve elements. This requirement for accurate alignment usually required manual insertion of the punch rod and prevented use of apparatus providing mechanical insertion of the rod.

Further many tuyere sealing means and silencers used to date have required punch rods having special configurations in order to assure sealing engagement with valve elements.

It is an object of my invention to provide for a sealing means and silencer which includes guide slots to guide and provide support for individual valve elements so as to assure that the guide elements may be moved radially outwardly of the tuyere sealing means notwithstanding misalignment of a punch rod and to insure that the movable valve elements will not be bent. It is a further object of the invention to provide for a tuyere sealing means having movable valve elements which will closely engage with and seal with the surface of the shank portion of a punch rod where the engaging surface of the valve elements are complementary in shape to the surface of the outer periphery of the rod.

GENERAL DESCRIPTION OF THE INVENTION

Generally a tuyere sealing means and silencer constructed according to my invention includes a bell-shaped nozzle having a plurality of axially extending cutouts in the narrow end of the nozzle which form guide slots. A ramp-type valve element is included in each guide slot. Each valve element includes a damp segmant and an arcuate segment forming part of a tapered guide surface where the arcuate segment is joined to the ramp segment by an axial center segment. A ramp segment fits into a guide slot such that the guide slot supports and guides a valve element for movement in a radial direction with respect to the nozzle. Spring means are included for urging the valve elements towards each other so that the valve elements will closely contact and seal with the periphery of a punch rod. A check valve is associated with the sealing means and silencer to prevent flow-back of gases or liquids to the valve elements during the time a punch rod is not inserted into the sealing means. The check valve is adapted to be opened by contact with the end of the punch rod.

BEST MODE FOR CARRYING OUT THE INVENTION

Figure 1:
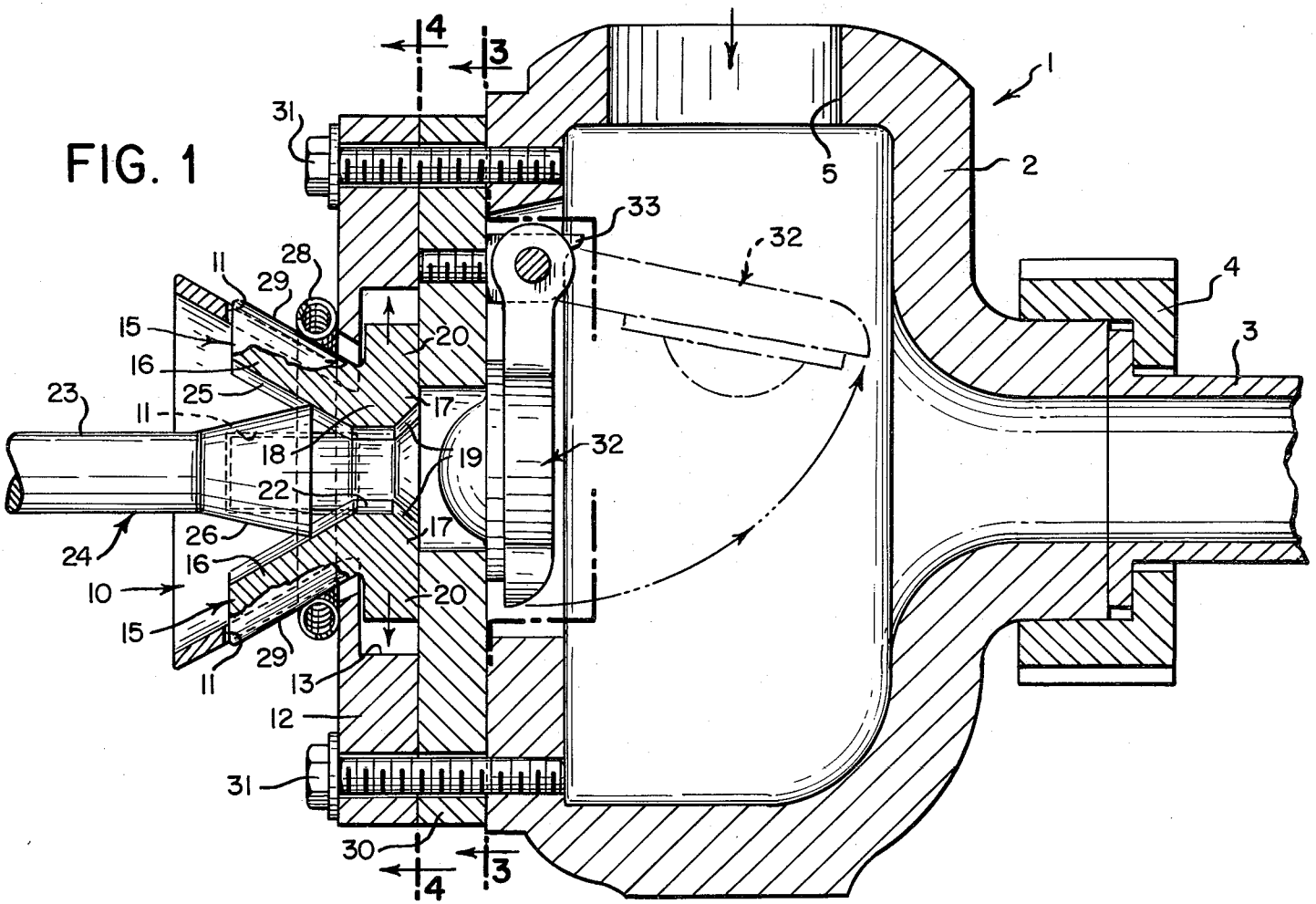
FIG. 1 is a side sectional view of a tuyere sealing means and silencer constructed according to the invention.
Figure 3:
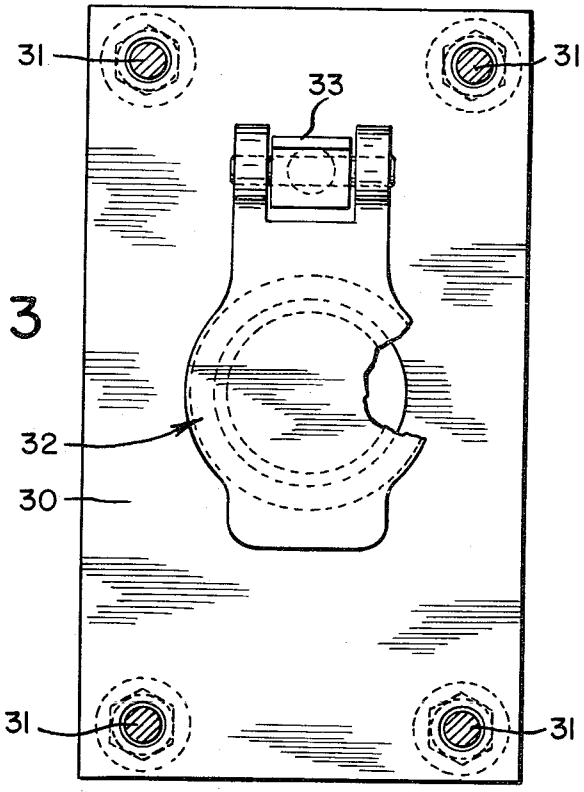
FIG.3 is a view of FIG. 1 taken along lines 3-3.

Referring to FIG. 1 there is illustrated a tuyere sealing means and silencer 1 having a casing 2 adapted to be connected to a tuyere pipe 3 by a connection 4 where the tuyere pipe leads into a converter, not shown. Casing 2 has an inlet 5 through which gas flows from a gas supply source.

The tuyere sealing means and silencer comprises a bell-shaped nozzle 10 having a plurality of axially extending cutouts or guide slots 11 and a base 12. The base 12 has a counter bore 13 therein forming a circular recess.

Figure 5:
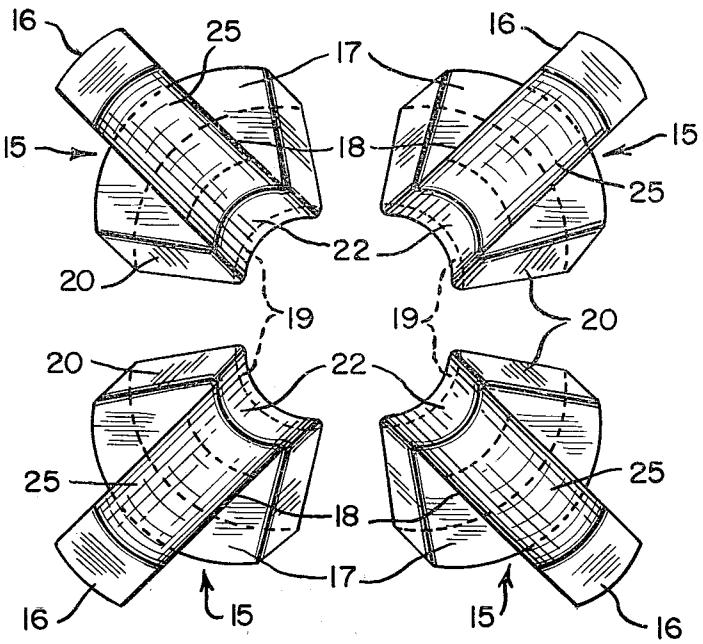
FIG. 5 is an exploded view of valve elements utilized in FIG. 1.
Figure 4:
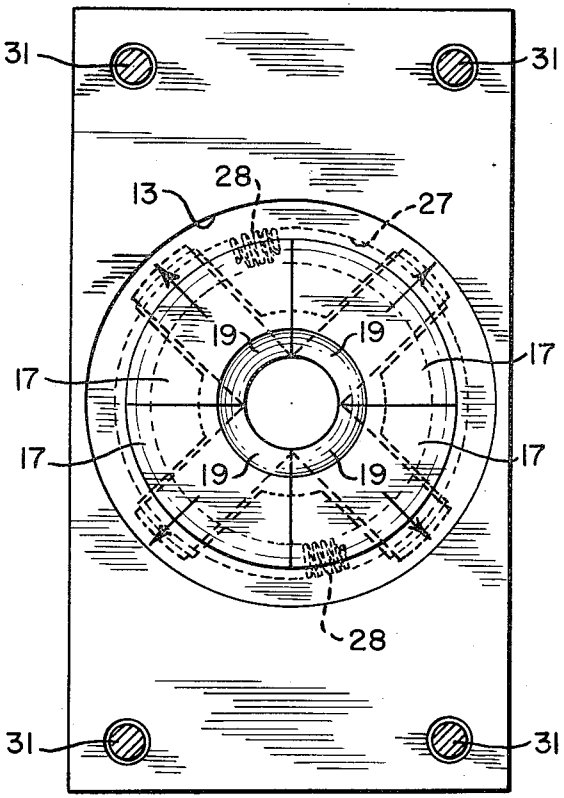
FIG. 4 is a view of FIG. 1 taken along lines 4-4.

A plurality of valve elements 15 are included so that one valve element is slidable in each cutout. As shown in FIG. 1, each valve element includes a ramp segment 16 and an arcuate segment 17 which is joined to the ramp segment by way of an axial center segment 18. As shown by FIG. 5 which is an exploded view looking in the ramp end of the valve elements and by FIG. 4, each of the arcuate segments 17 forms one-quarter of a tapered guide surface 19 and includes a radially extending leg 20. As shown in FIG. 1, legs 20 are radially movable within the counter bore 13.

The axial center segment 18 of each valve segment has a curved surface 22 which is adapted to seal with a shank portion 23 of a cylindrical punch rod 24. In addition each ramp segment has a curved surface 25 adapted to engage with the enlarged cylindrical head portion 26 of the punch rod. Surface 19 in addition to being tapered is also curved so that it is complementary to and may engage the cylindrical edge of the head portion 26. While the punch rod 24 is shown as being cylindrical, it is to be understood that the shank and head portion could have flat surfaces in which event the surfaces 19, 22 and 25 of the valve elements would also be flat.

Figure 2:
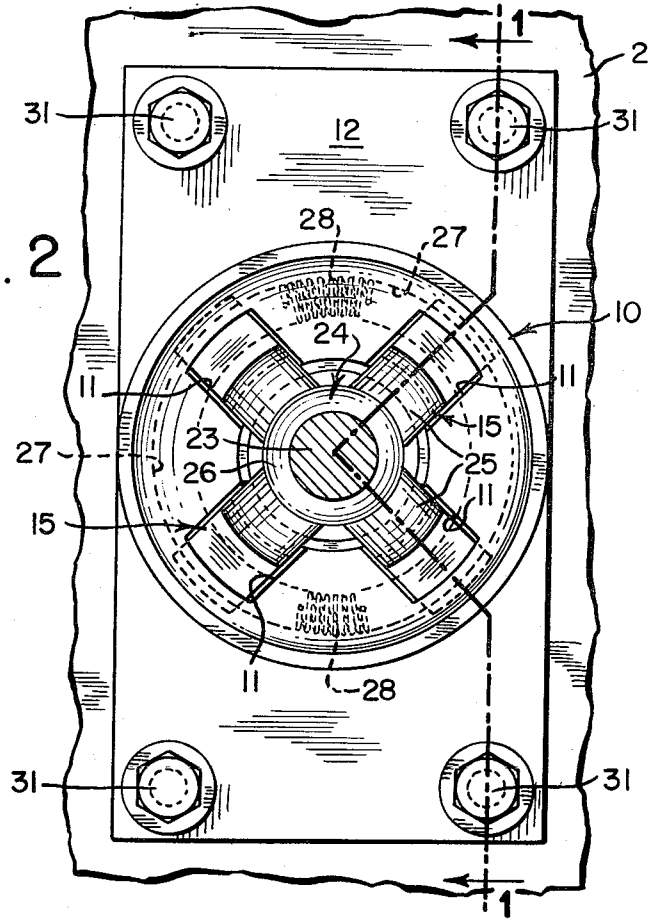
FIG. 2 is an end view of FIG. 1 in the direction of punch rod movement into the sealing means.

The nozzle 10 has a groove 27 shown in dotted form in FIG. 2 into which a garter-type endless spring 28 is positioned so as to engage the outer surfaces 29 of the individual valve elements to urge the valve elements inwardly towards each other.

A valve plate 30 joins the base 12 with the base 12 and valve plate being connected to the casing 2 by way of bolts 31. A flapper-type check valve 32 is mounted on the valve plate 30 by way of a valve bolt 33 welded to the valve plate 30.

The operation of the device is as follows. The enlarged head portion 26 of the punch rod 24 is inserted into the nozzle 10 so as to contact the ramp segments of the valve elements. Continued movement of the rod in the right-hand direction will cause the valve elements to move radially outwardly of the punch rod against the force of garter spring 28. Because the side walls of the slots 11 and walls of the counter bore 13 as well as the end of the valve plate 30 act as supports for the valve elements, there is no danger of the valve elements being bent due to any misalignment of the rod 24. Continued movement of the rod 24 in the right-hand direction will cause the end of the rod to contact the flapper valve 32 to swing it into the open position shown in the dotted lines of FIG. 1. Continued movement of the rod will allow the enlarged head 26 to engage and clean the interior of the tuyere pipe 3. As the head portion of the rod moves beyond the axial segments 18, the valve elements will move under the force of spring 28 radially inwardly to assure that the surface 18 will remain in sealing engagement with the surface of the head 26, and as the rod moves further to the right in sealing contact with the surface of the shank portion 23 of the rod.

Withdrawal of the punch rod is accomplished by moving the rod in the left-hand direction as shown in FIG. 1. As the head portion 26 of the punch rod contacts the tapered guide surface 19, the valve elements will again be moved radially outwardly against the force of the spring 28 to allow removal of the head section of a punch rod at which time the flapper valve 32 will move to a closed position.

The valve elements are case-hardened to resist wear and, because of the support offered by the slots and sides of counter bore, will effectuate a strong seal with a periphery of a punch rod over a long period of use notwithstanding any misalignment of the punch rod.

Further positioning of the garter spring exteriorly of the nozzle allows convenient replacement of the spring in the event of wear and allows use of various size springs if for any reason it is necessary to vary the force of sealing engagment of the valve elements with the punch rod.

I claim:

1. A tuyere sealing means and silencer comprising a bell-shaped nozzle, a plurality of axially extending guide slots in said nozzle, a radially movable ramp-type valve element in each said guide slot adapted to be engaged by a punch rod wherein each said valve element has an arcuate segment, a ramp segment movable in said guide slot, and an axial center segment joining said ramp segment and said arcuate segment, and spring means urging all of said valve elements inwardly towards each other.

2. A tuyere sealing means and silencer according to claim 1 wherein said axial center segment has a surface adapted to complement and seal with the exterior surface of the shank portion of a punch rod when a punch rod is inserted through said nozzle.

3. A tuyere sealing means and silencer according to claim 1 wherein said nozzle has a groove extending around the outer periphery thereof near the area of said guide slots and where said spring means comprises a garter-type endless spring in said groove engaging said valve elements.

4. A tuyere sealing means and silencer according to claim 1 having in addition movable check valve means adapted to be opened by the end of a punch rod inserted through said nozzle and adapted to be closed by pressure within a tuyere body.

5. A tuyere sealing means and silencer according to claim 4 wherein said check valve means comprises a flapper-type valve.

6. A tuyere sealing means and silencer according to claim 1 wherein the arcuate segment forms part of a tapered guide surface for engaging against the punch rod as the rod is moved through the sealing means and silencer.

* * * * *